US008136939B2

(12) United States Patent
Reid

(10) Patent No.: US 8,136,939 B2
(45) Date of Patent: Mar. 20, 2012

(54) COLLAPSING COVER FOR A CUSTOMER REPLACEABLE UNIT USED IN A PRINTER

(75) Inventor: Brian Noel Reid, Welwyn Garden City (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/082,975

(22) Filed: Apr. 8, 2011

(65) Prior Publication Data

US 2011/0187805 A1 Aug. 4, 2011

Related U.S. Application Data

(62) Division of application No. 11/982,954, filed on Nov. 6, 2007, now Pat. No. 7,959,283.

(51) Int. Cl.
*B41J 29/13* (2006.01)

(52) U.S. Cl. ..... 347/108

(58) Field of Classification Search ..... None
See application file for complete search history.

(56) References Cited

U.S. PATENT DOCUMENTS

| | | | | |
|---|---|---|---|---|
| 4,876,606 | A * | 10/1989 | Banno et al. | 358/434 |
| 4,943,828 | A | 7/1990 | Manabe et al. | |
| 6,831,229 | B1 | 12/2004 | Määttä et al. | |
| 6,975,889 | B2 | 12/2005 | Chen et al. | |
| 7,002,073 | B2 | 2/2006 | Lai et al. | |
| 7,084,345 | B1 | 8/2006 | Chen et al. | |
| 7,157,648 | B2 | 1/2007 | Park | |
| 2004/0246318 | A1 * | 12/2004 | Askren et al. | 347/96 |
| 2006/0239752 | A1 | 10/2006 | Shiraishi et al. | |

* cited by examiner

*Primary Examiner* — Matthew Luu
*Assistant Examiner* — Kendrick Liu
(74) *Attorney, Agent, or Firm* — Maginot, Moore & Beck, LLP

(57) ABSTRACT

An integrated device enables a customer replaceable unit used within an ink jet printer to be enclosed within an enclosing structure as the unit is removed from the printer. The enclosing structure traps debris that may disburse from the customer replaceable unit as it is removed from the printer. The integrated device includes an extendable cover that encloses the customer replaceable unit in response to one end of the cover being moved away from the other end.

11 Claims, 6 Drawing Sheets

COLLAPSING COVER FOR A CUSTOMER REPLACEABLE UNIT USED IN A PRINTER

PRIORITY CLAIM

This application is a divisional application that claims priority to the commonly owned and co-pending U.S. patent application Ser. No. 11/982,954, which was filed on Nov. 6, 2007 and is entitled "Collapsing Cover For Printer And Associated Method."

TECHNICAL FIELD

The device described herein generally relates to printers that generate hard copies of documents using marking materials, such as ink or toner. More specifically, the device relates to a cover for a printer component that can be removed and replaced by a user.

BACKGROUND

"Printers" refer to reproduction devices in general, such as printers, facsimile machines, copiers, and related multi-function products. These printers are used to produce a printed image on media. The printed image is comprised of pixels, which are small masses of marking material. Common marking materials include dry ink, toner, with and without metal particles, wet inks of many forms, such as aqueous ink or ink suspensions, and solid inks that are melted during use. The marking materials may be directly applied to media, either in sheet or web form, or to an intermediate member before being transferred to media. The process of producing the image and fixing it to some form of media may require several steps and many components to perform the several steps.

The media, the ink, and the release agent used or consumed in the printing process are commonly known as consumables. The consumables need to be regularly added to the machine. These consumables may produce debris that is distributed throughout the printer. For example, paper sheets may have dust or other particulate matter on their surfaces that impregnate the air and flow through the recesses and pathways of the printer. Dry inks, such as toner, are developed onto latent images using clouds of the marking materials. Some of the toner material in the clouds not captured by the latent image and not returned to a development station may migrate through the printer. Other marking materials, such as wet inks, may generate residual waste ink that needs to be removed from the machine. Thus, the environment within a printer can contain particulate and other matter that may be considered messy or dirty.

Many printers include components that a customer can easily remove when spent or worn so a new component can be installed. This type of component is typically referred to as a "customer replacement unit" and may include receptacles for waste materials or consumables. A drum maintenance unit that applies release agent to an intermediate imaging member is an example of a customer replacement unit. When a customer replaceable unit is removed by a customer, the customer may encounter debris that has been distributed in the printer. The amount of debris may make a customer uncomfortable with the task of replacing customer replaceable units.

SUMMARY

An integrated device enables a customer replaceable unit within an ink jet printer to be enveloped within an enclosing structure as the unit is removed from the printer. The enclosing structure traps debris that may disburse from the customer replaceable unit as it is removed from the printer. The integrated device includes a customer replaceable unit that is mountable within a printer; a handle mounted to and extending from one end of the customer replaceable unit; and an extendable cover having a first end and a second end, the first end of the extendable cover being coupled to the handle and the second end of the extendable cover being configured for connection with a stationary structure within the printer, the cover being configured to withdraw the customer replaceable unit past the second end of the cover in response to the first end of the cover being moved away from the first end of the cover.

This device enables the customer replaceable unit and its collapsible cover to be installed in a printer. The customer replaceable unit is exposed for performing its function while the cover remains stored proximate the handle extending from the customer replaceable unit. When the handle of the customer replaceable unit is removed from the printer, the customer replaceable unit is retracted within the cover, which extends as the first end is moved away from the second end. As the customer disengages the second end from the printer, the second end can be closed to encase the customer replaceable unit and any associated debris within the extended cover.

A printer includes an integrated device that enables a customer replaceable unit within an ink jet printer to be enclosed within an enclosing structure as the unit is removed from the printer. The enclosing structure traps debris that may disburse from the customer replaceable unit as it is removed from the printer. The printer includes a frame, a customer replaceable unit that is coupled to the frame, a handle mounted to and extending from one end of the customer replaceable unit, and an extendable cover. The cover has a first end and a second end, the first end of the extendable cover being coupled to the handle, the second end of the extendable cover being configured to couple to the frame within the printer to compress the extendable cover and locate the first and the second ends of the cover about a portion of the handle to extend the customer replaceable unit beyond the second end of the cover. Removal of the handle from the printer moves the first end away from the second end connected to the stationary structure to extend the cover and withdraw the customer replaceable unit within the extended cover so the second end can be disengaged from the frame and the cover closed about the customer replaceable unit.

A method enables a customer replaceable unit within an ink jet printer to be enclosed within an enclosing structure as the unit is removed from the printer. The enclosing structure traps debris that may disburse from the customer replaceable unit as it is removed from the printer. The method reduces debris during removal of a customer replaceable unit from an ink jet printer and may be implemented with the integrated device. The method includes securing a first end of an expandable cover to a stationary structure within an ink jet printer and securing a second end of the expandable cover to a handle extending from a customer replaceable unit installed in the ink jet printer, the first and the second ends of the expandable cover being secured to center the two ends of the cover approximately about a portion of the handle and a longitudinal center line of the customer replaceable unit. After the cover is installed, it may be used during removal of the customer replaceable unit by removing the handle along a path that parallels the longitudinal center line of the customer replaceable unit to move the first end of the expandable cover from the second end of the expandable cover as the second end remains secured to the stationary structure of the ink jet printer, extending the cover in response to the removal of the handle, and withdrawing the customer replaceable unit within the extended cover. The customer replaceable unit may then be enveloped within the extended cover and the second end of the cover closed to keep the customer replaceable unit within the cover. The closed cover about the customer replaceable unit helps keep debris from being released within the ink jet printer and from dirtying the operator's hands and clothes.

BRIEF DESCRIPTION OF THE DRAWINGS

Features of the present invention will become apparent to those skilled in the art from the following description with reference to the drawings, in which.

DETAILED DESCRIPTION

The term "printer" refers, for example, to reproduction devices in general, such as printers, facsimile machines, copiers, and related multi-function products. These devices use marking materials to generate an image on media.

Figure 1:
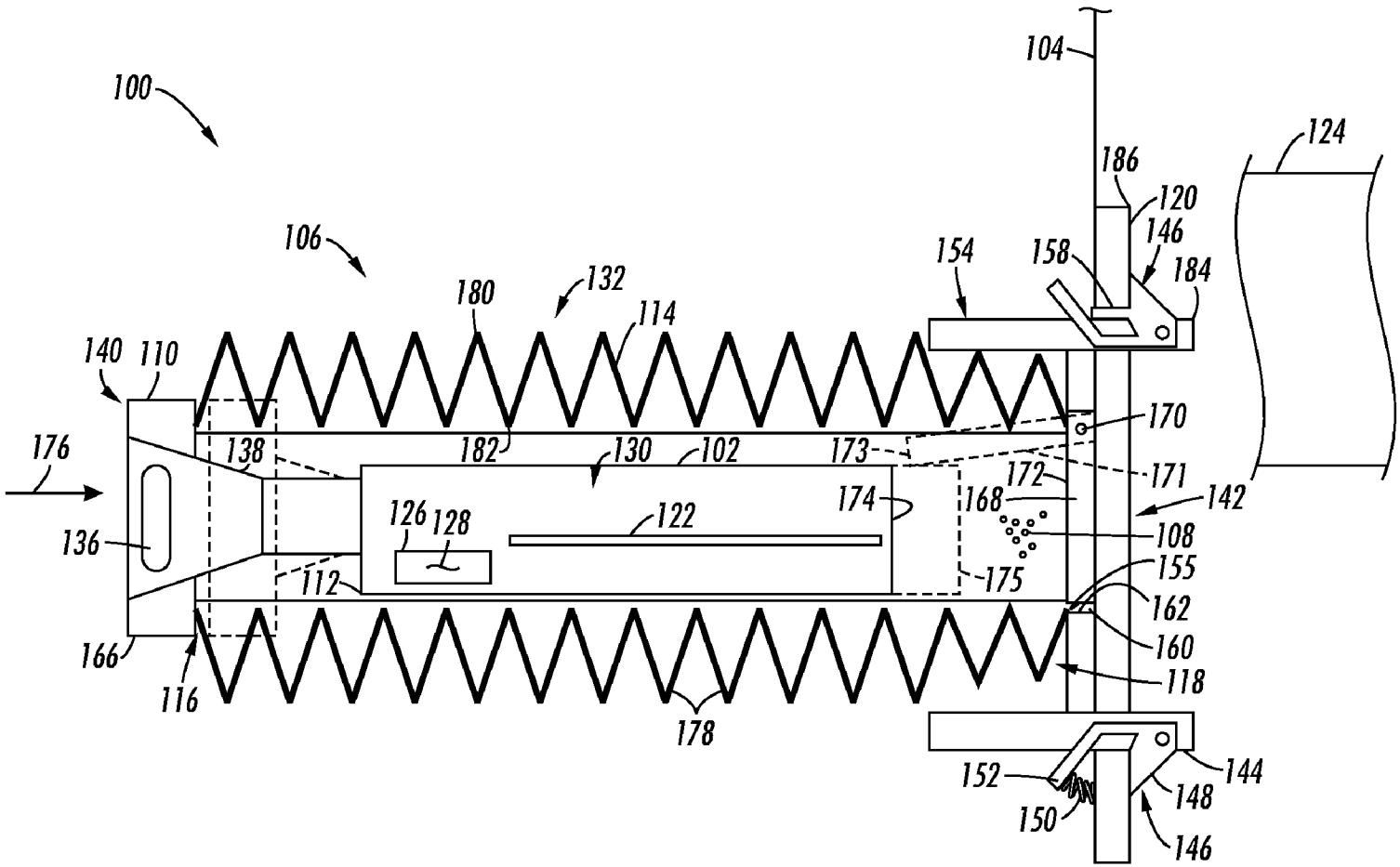
FIG. 1 is a plan view, partially in cross section, of a customer replacement unit with an accordion type collapsing cover in position against an opening of a printer prior to installation of the customer replacement unit into the printer.
Figure 2:
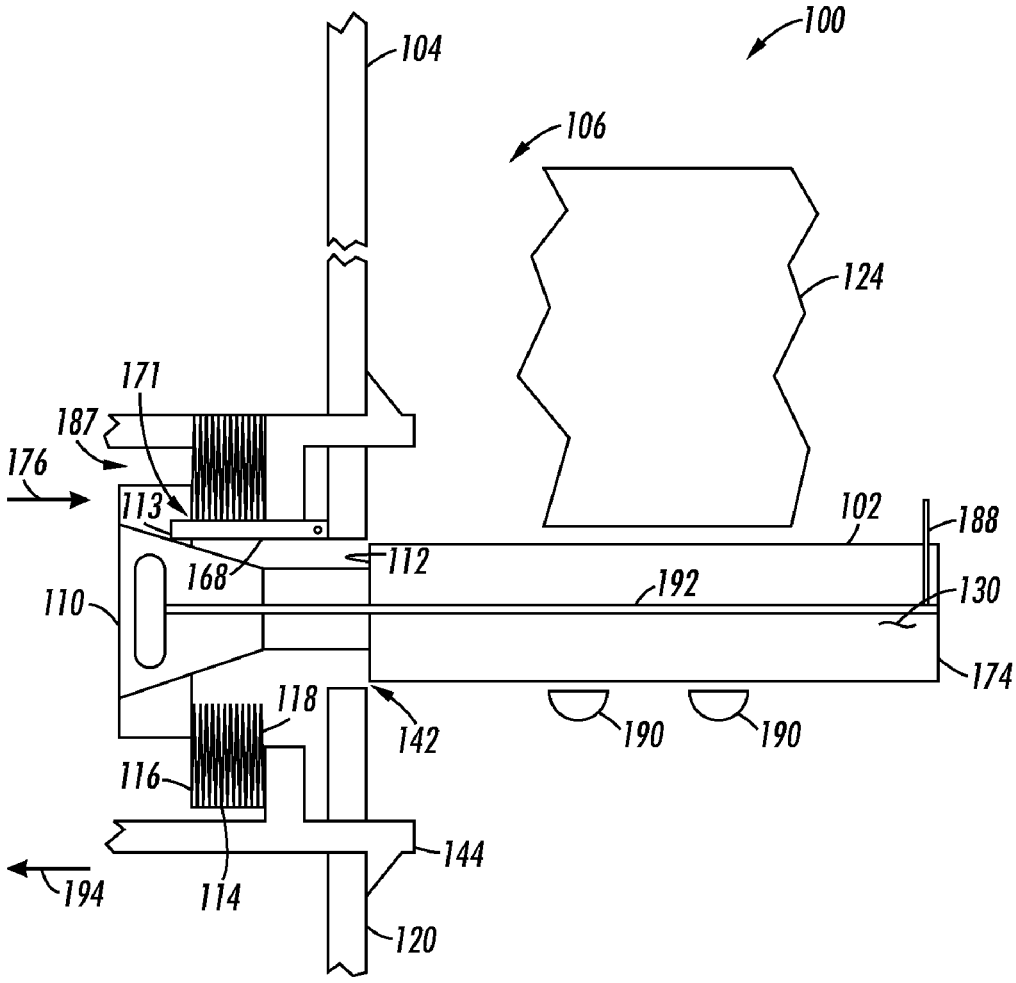
FIG. 2 is a plan view, partially in cross section, of the customer replacement unit with the collapsing cover of FIG. 1 after the customer replacement unit has been installed in the printer.

An integrated apparatus or device 100 is shown in FIG. 1. The integrated device 100 enables a customer replacement unit 102 within a printer 104 to be enveloped within an enclosing structure 106 as the unit 102 is removed from the printer 104. The enclosing structure 106 traps debris 108 that may disperse from the customer replacement unit 102 as it is removed from the printer 104. The integrated device 100 includes the customer replacement unit 102 that is mountable within the printer 104 and a handle 110 mounted to and extending from one end 112 of the customer replacement unit 102. In one embodiment, the integrated device 100 also includes an extendible cover 114 having a first end 116 and a second end 118. The first end 116 of the extendible cover 114 is coupled to the handle 110. The second end 118 of the extendible cover 114 is configured to couple to a frame 120 within the printer 104. The customer replaceable unit is withdrawn into the cover as the handle is pulled to move the front end 116 away from the second end 118 of the cover 114. Thus, the second end 118 may extend past the customer replacement unit 102 (as shown in FIG. 1) or be proximate the first end 116 to expose the customer replacement unit 102 (as shown in FIG. 2).

The customer replacement unit 102 may include any component or groups of components so designed for replacement by the customer. For example, the customer replacement unit may be in the form of a receptacle for waste, a container including consumables, a replacement component, or a combination thereof. For example, the customer replacement unit 102 may be a drum replacement unit. The drum replacement unit may include a blade 122 for cleaning a drum 124, and a container 126 for storing release oil 128 to apply to the drum 124.

The integrated device 100 including the extendable cover 114 is typically designed in size and shape to closely conform to the periphery 130 of the customer replacement unit 102. The customer replacement unit 102 may have any suitable shape and may be rectangular, cylindrical or have any other shape, which is suited for the components of the customer replacement unit 102. The extendible cover 114 extends over and surrounds periphery 130 of the customer replacement unit 102. The cover 114 may have any construction such that the cover 114 is collapsible. For example, the cover may be in the form of a telescoping structure, an accordion structure, or in the form of a flexible wall. The extendible cover 114 rests upon the upper portion 132 of the customer replacement unit 102. Alternately, the extendible cover 114 may support itself. Alternately, a frame (not shown) may extend between the customer replacement unit 102 and the extendible cover 114 to support the extendible cover 114.

The handle 110 extends from first end 112 of the customer replacement unit 102. The handle 110 serves to provide a feature such that the customer replacement unit 102 may be inserted into the printer 104. The handle 110 may have any suitable shape and may include a transverse slot 136 for passage of the fingers to provide a gripping mechanism for the handle 110. The handle 110 may alternatively include recesses or features to conform to the hand to assist in the holding of the handle 110. The handle 110 may further include a connector 138 positioned between the handle 110 and the customer replacement unit 102 and an end cover 140 positioned between the handle 110 and the first end 116 of the extendible cover 114. The end cover 140 may be utilized to close the cover 114. The reader should appreciate that the handle 110, the connector 138, and the end cover 140 may be integral. The handle 110 may be connected to customer replacement unit 102 in any suitable fashion, such as by weldment, glue, fasteners, or interference fit. The handle 110 may be configured to receive a human hand whether the handle is in a vertical position as shown in FIG. 1, or alternatively, in a horizontal or oblique position. The handle 110, the connector 138, and the end cover 140 may be made of any suitable durable material and may be made of a polymer, a metal, or a composite material.

The integrated device 100 is connected to stationary structure 120 of the printer 104 in any suitable fashion. For example, the customer replacement unit 102 may be fitted to an opening 142 formed in the stationary structure of the printer 104. Alternatively, the customer replacement unit 102 may include a mounting plate 144 fitted to the stationary structure 120 of the printer 104. The mounting plate 144 may have any suitable configuration and may be connected, as shown in FIG. 1, to extendable cover 114 and/or to customer replacement unit 102. The mounting plate 144 may include a feature 146 for securing the plate 144 to the structure 120. The feature as shown is a latch 146 having a protrusion 148 that engages the stationary structure 120. The latch 146 includes a spring 150 to bias the latch 146 into a locking engagement with the stationary structure 120. The latch 146 further includes a release lever 152 for releasing the latch 146. A solitary latch 146 or a pair of opposed latches 146 may be used. The mounting plate 144 has an outer periphery 154 that fits in opening 142 formed in the stationary structure 120 of the printer 104. The mounting plate 144 includes a surface 155 that defines a central opening 142 through which the periphery 130 of the customer replacement unit 102 passes. The mounting plate 144 may include a plate mounting seal 158 to seal the mounting plate 144 to the support structure 120 and a customer replacement unit seal 160 to seal the mounting plate 144 to the customer replacement unit 102. The mounting plate 144 may also include a surface 162 for connecting the second end 118 of the cover 114.

The integrated device 100 may further include a feature for covering the second end 118 of the cover 114 when the extendible cover 114 is in fully extended position 166 as shown in solid in FIG. 1. The feature as shown is a moveable door 168 that pivots on hinges 170 secured to mounting plate 144. The door 168 as shown in FIG. 1 is positioned in open position 171 as shown in phantom when the customer replacement unit 102 is in position 175 to install the customer replacement unit as shown in phantom. The door 168 remains in open position 171 by bottom 173 of door 168 sliding along the upper portion 132 of the periphery 130 of customer replacement unit 102 as the customer replacement unit 102 is moved in the direction of arrow 176 as the customer replacement unit 102 is installed into the printer 104. The door 168 moves to closed position 172 as shown in solid when the cover 114 is in fully extendible position 166 as the used customer replacement unit 102 is being removed and the bottom 173 of the door 168 passes the second end 174 of the customer replacement unit 102. The reader should appreciate that alternatively, the door 168 may include springs or other mechanisms to assist its closing and/or opening.

The integrated device 100 may further include a shipping seal (not shown) for sealing the second end 118 of the cover 114 when the customer replacement unit 102 is new and the door 168 of the apparatus 100 is in open position 171. The shipping seal may be removed prior to installation of a new customer replacement unit and may be reinstalled upon removing a used customer replacement unit. A new customer replacement unit 102 should not include debris, and, thus, complex new unit packaging including a shipping seal may not be needed.

The mounting plate 144 and the latch 146 may be made of any suitable durable material and may, for example, be made of a plastic, a polymer, a metal or a composite. The extendible cover 114 may be made of suitable, durable material. For example, the extendible cover 114 may be made of a metal, polymer, a composite or be made of paper. If the cover is made of paper, the extendible cover 114 may be made of corrugated paper. The extendible cover 114 as shown in FIG. 1 includes a plurality of disks 178 with the outer portions 180 of adjacent disks 178 connected and with inner portions 182 of adjacent disks 178 connected. As shown, the disks 178 of cover 114 are made from an integral piece. Alternatively, the disks 178 may each be made of a separate component and glued or otherwise connected to each other.

Referring now to FIG. 1, the reader should appreciate that the integrated device 100 may require support of an operator when in the fully extended position 166 as shown in FIG. 1. Once the customer replacement unit 102 reaches support surface 155 of the mounting plate 144, the support surface 155 may support the customer replacement unit 102. Of course, other constructs may be available to support the customer replacement unit 102 when in the extended position 166. For example, a central rod (not shown) or an outer cradle (not shown) may be utilized to support the customer replacement unit 102 when in extended position 166.

As shown in FIG. 1, the customer replacement unit 102 is connected to the printer 174 by advancing the customer replacement unit 102 in the direction of arrow 176 until pilot 184 of the hub 154 of the mounting plate 144 is fitted into opening 142 of the printer 104. The customer replacement unit 102 is further advanced in the direction of arrow 176 until the protrusions 148 of latches 146, upon being collapsed, pass through the opening 142 and engage inner face 186 of the support structure 120 of the printer 4.

To install the customer replacement unit 102 into the printer 104, the customer replacement unit 102 is advanced in the direction of arrow 176 from extended position 166 as shown in FIG. 1 to contracted position 187 as shown in FIG. 2. In the contracted position 187, second end 174 of the customer replacement unit 102 engages drive mechanism 188 and printer support surfaces 190 are used to support the customer replacement unit 102 when in position in the printer 104. As the customer replacement unit 102 is advanced in the direction of arrow 176, the bottom 173 of the door 168 moves along the outer periphery 130 of the customer replacement unit 102 until it arrives between handle 110 and the contracted position 187 of the cover 114. In the contracted position 187, the door 168 remains in the open position 171 as shown in solid. The handle 110 is connected to a customer replacement unit latch mechanism 192 that engages drive mechanism 188 to latch the customer replacement unit 102 into the printer 104 and to notify the printer 104 by an electric switch (not shown) that the customer replacement unit 102 is in position in the printer 104.

Referring to FIG. 1, to remove a used customer replacement unit 102, the unit 102 is advanced in the direction of arrow 194 by grasping the handle 110, disengaging the customer replaceable unit from the frame 120 and withdrawing the handle 110. The cover expands while the customer replacement unit 102 slides along support surface 155 of the mounting plate 144 and the bottom 173 of the door 168 moves along outer periphery 130 of the customer replacement unit 102 until the bottom 173 of the door 168 passes by second end 174 of the customer replacement unit 102. At this point, the door 168 moves by gravity from open position 171 to closed position 172.

Figure 3:
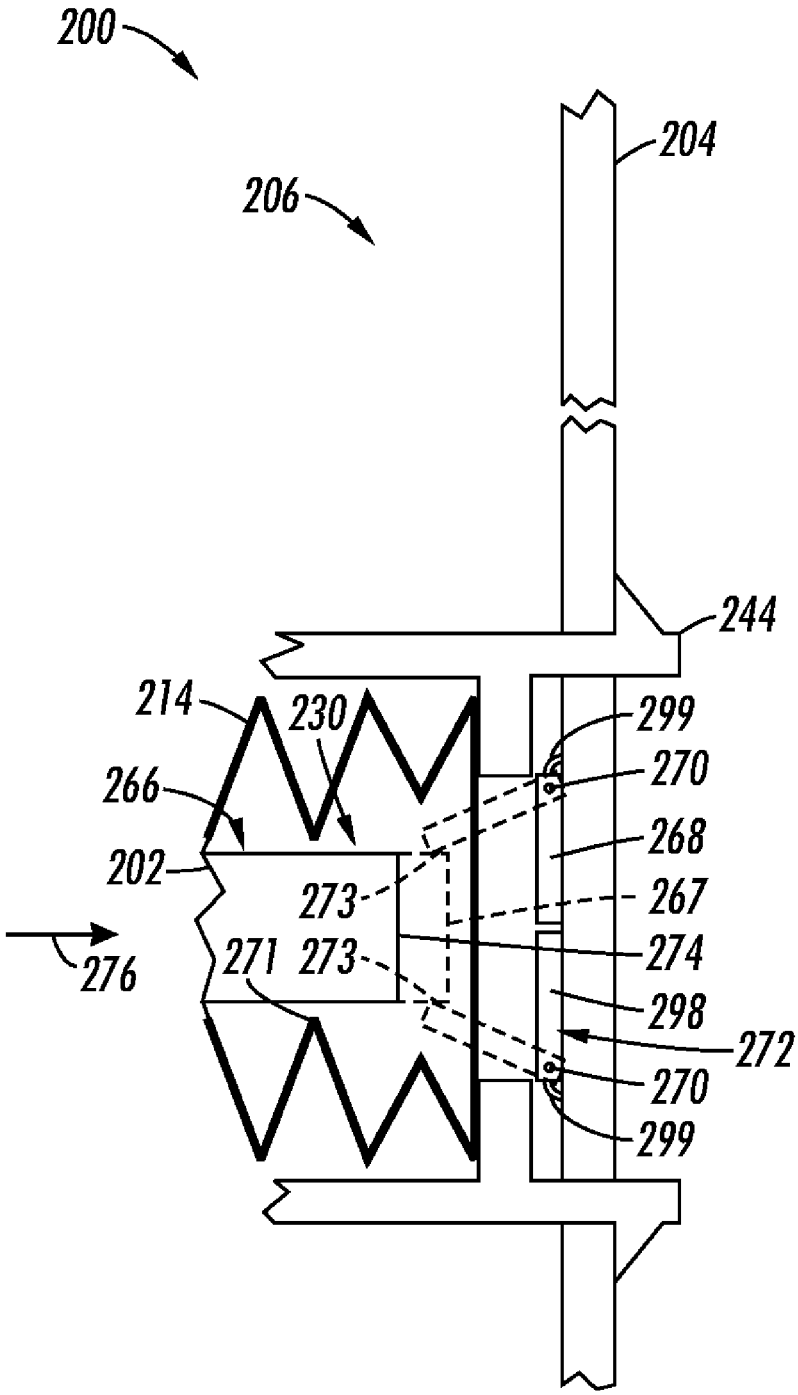
FIG. 3 is a partial plan view, partially in cross section, of another embodiment of a collapsing cover having a two piece door for closing the cover at the end of the customer replacement unit.

Referring now to FIG. 3, integrated device 200, which utilizes enclosing structure 206, is shown. The integrating apparatus 200 is similar to the integrated device 100 of FIGS. 1 and 2, except that the integrated device 200 includes a plurality of doors. For example, the integrated device 200 includes a first movable door 268 as well as a second movable door 298. The first door 268 and the second door 298 are pivotally positioned about hinges 270 and may be biased into the closed position 272 as shown in solid. The doors 268 and 298 are biased into closed position 272 by, for example, springs 299 positioned about the hinges 270. The hinges 270 are mounted to mounting plate 244 in a similar manner to the mounting plate 144 of FIGS. 1 and 2.

The doors 268 and 298 each of which includes a bottom 273 that rests on the outer periphery 230 of the customer replacement unit 202 to place the doors 268 and 298 in door open position 271. When the customer replacement unit 202 is in the load position 267, shown in phantom, the doors 268 and 298 remain in door open position 271 as bottoms 273 of doors 268 and 298 slide along the periphery 230 of the customer replacement unit 102 during movement of the customer replacement unit 102 in the direction of arrow 276 for installation in the printer 204. The doors 268 and 298 move to closed position 272 as shown in solid when the cover 214 is in fully extendible position 266, also shown in solid, as the used customer replacement unit 202 is removed and bottoms 273 of doors 268 and 298 pass the second end 274 of the customer replacement unit 202. The first door 268 and the second door 298 may be positioned in any attitude, particularly if the springs 299 are utilized to bias the doors 268 and 298 in closed position 272. If the first door 268 is positioned above the customer replacement unit 202, the first door 268 may operate by gravity and not require a spring.

Figure 4:
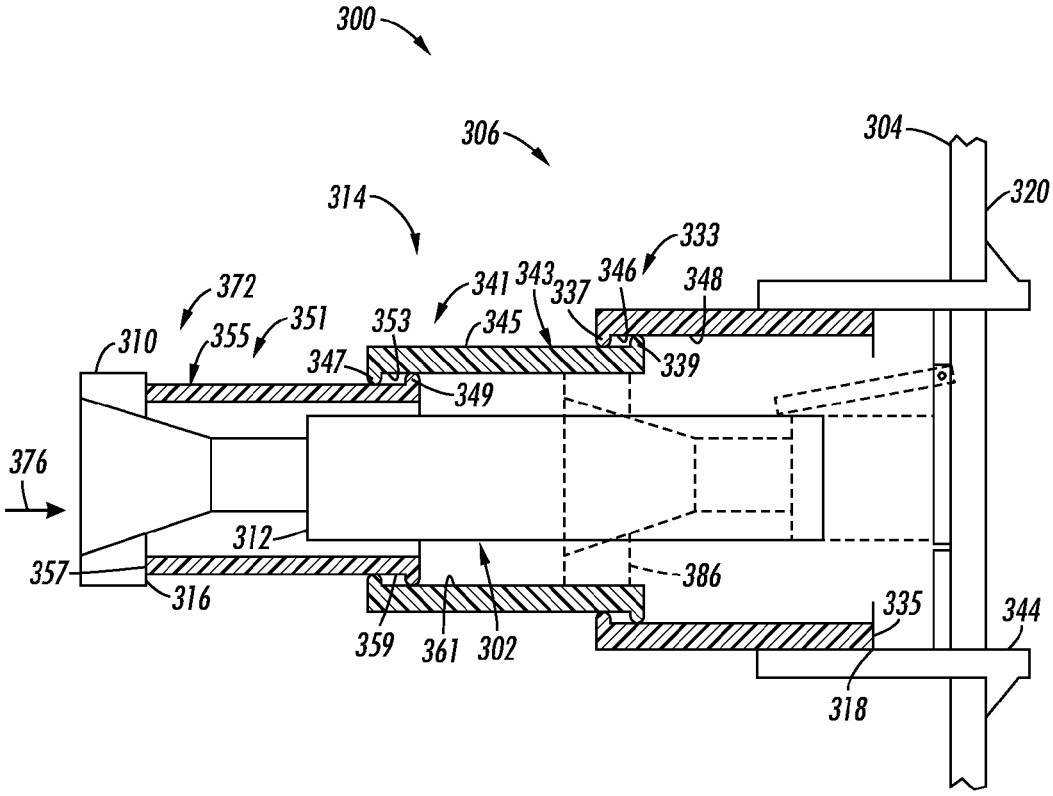
FIG. 4 is a plan view, partially in cross section, of a customer replacement unit with a telescopic type collapsing cover.

Referring now to FIG. 4, integrated device 300 which utilizes enclosing structure 306 is shown. The integrated device 300 is similar to the integrated device 100 of FIGS. 1 and 2, except that the integrated device 300 includes an extendable cover 314 that is different from the extendable cover 114 of the integrated device 100. The integrated device 300 includes a customer replacement unit 302 which is supported on one end 312 of the customer replacement unit 302 by handle 310. The extendible cover 314 includes a first end 316 connected to the handle 310 and a second end 318 connected to mounting plate 344. The mounting plate 344 serves to mount the integrated device 300 to support structure 320 of the printer 304. The extendible cover 314 is in the form of a telescoping cover and includes a plurality of tubes with at least an outer tube that slides over an inner tube. The extendible cover 314 may include any plural number of tubes, for example two, four, five or more tubes.

As shown in FIG. 4, the extendible cover 314 include three tubes including an outer tube 333. A first end 335 of the outer tube 333 may be rigidly connected to mounting plate 344. The outer tube 333 includes an inner lip 337 that interlocks with an outer lip 339 formed in middle tube 341. The lips 337 and 339 serve to prevent the middle tube 341 from separating from the outer tube 333. The inner lip 337 of the outer tube 333 may include an inner surface 343, which is in sliding contact with the outer periphery 345 of the middle tube 341. The outer lip 339 of the middle tube 341 includes an outer surface 346, which is sliding contact with the inner periphery 348 of the outer tube 333. The middle tube 341 includes an inner lip 347 which mates with an outer lip 349 formed on inner tube 351. The lips 347 and 349 serve to prevent the inner tube 351 from separating from the middle tube 341. The inner lip 347 of the middle tube 341 includes an inner surface 353, which is in sliding contact with the outer surface 355 of the inner tube 351. The outer lip 349 of the inner tube 351 includes an outer surface 359 which is in sliding contact with the inner surface 361 of the middle tube 341. A second end 357 of the inner tube 351 is mounted to handle 310.

As the cover 314 is moved from the fully extended position 372, as shown in solid, to the contracted position 386, as shown in phantom, the handle 310 of the integrated device 300 is moved in the direction of arrow 376. The middle tube 341 then moves relative to the inner tube 351 and the outer tube 333 moves relative to the middle tube 341 until the inner tube 351, the middle tube 341 and the outer tube 333 are in the position 386. The extendible cover 314 including the inner tube 351, the middle tube 341, and the outer tube 333 may be made from a durable material, such as a metal, a plastic, a composite or a paper. If made of paper, the tubes 333, 341 and 351 may be made of a corrugated paper.

Figure 5:
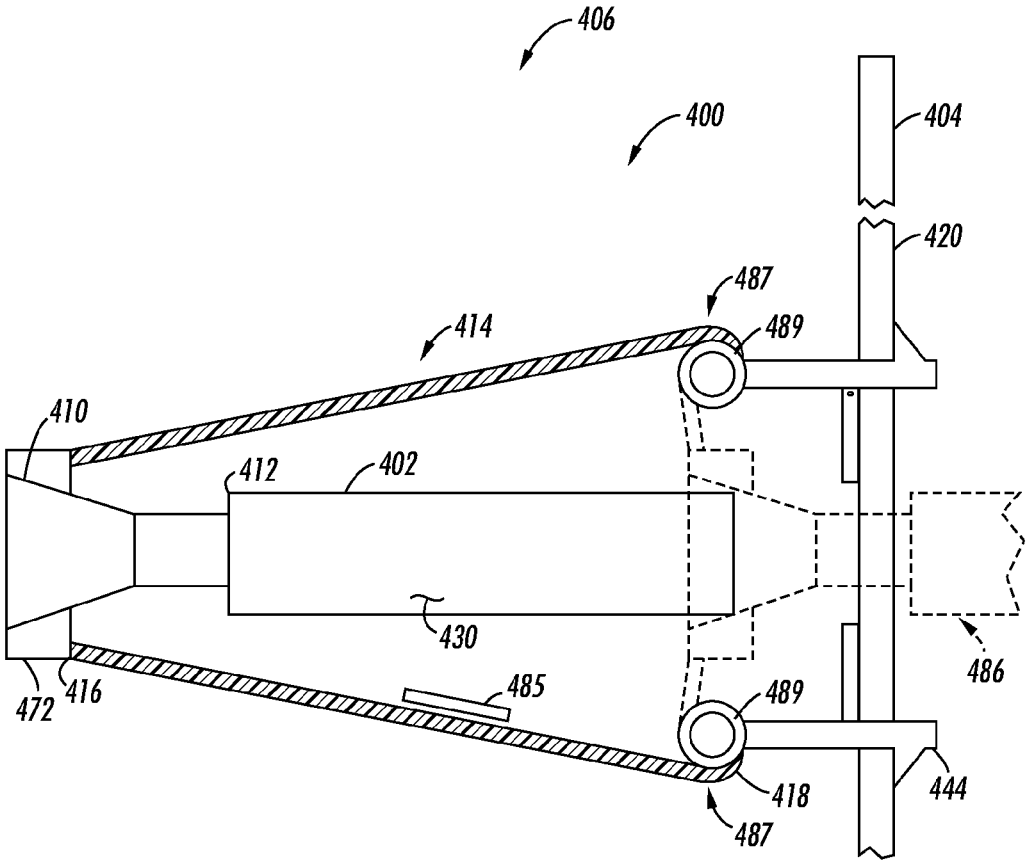
FIG. 5 is a plan view, partially in cross section, of a customer replacement unit with a flexible sleeve type collapsing cover.

Referring now to FIG. 5 an integrated device 400 including enclosing structure 406 is shown. The integrated device 400 is similar to the integrated device 100 of FIGS. 1 and 2 except that integrated device 400 includes an extendible cover 414 that is made of a flexible material. The integrated device 400 includes a customer replacement unit 402 having an end 412 to which handle 410 is connected. The extendible cover 414 extends from first end 416 of the cover 414, where it is connected to handle 410, to the second end 418 of the cover 414, where it is connected to mounting plate 444. The mounting plate 444 is secured to stationary structure 420 of printer 404. The extendible cover 414 may be in the form of a flexible film. For example, the extendible cover 414 may be a polymer film, a metal foil, or paper, including paper that is reinforced with, for example, fibers. The extendible cover 414 may also be made of compressible foam.

The extendible cover 414 may simply deform, crimple, or move in any fashion from extended position 472, as shown in solid, to retracted position 486, as shown in phantom. As shown in FIG. 5, the extendible cover 414 includes a retracting unit 487 having a biasing mechanism in the form of coil springs 489, which are utilized to keep the extendible cover 414 in a taut condition as it moved from the extended position 472 to the retracted position 486. The mechanism 487 may be similar to a mechanism for a window blind. A frame or structure 485 may alternatively be positioned between handle 110 and mounting plate 444 to prevent the extendible cover 414 from contacting periphery 430 of the customer replacement unit 402. Alternatively, the extendable cover 414 may ride or rest on the periphery 430 of the customer replacement unit 402.

Figure 6:
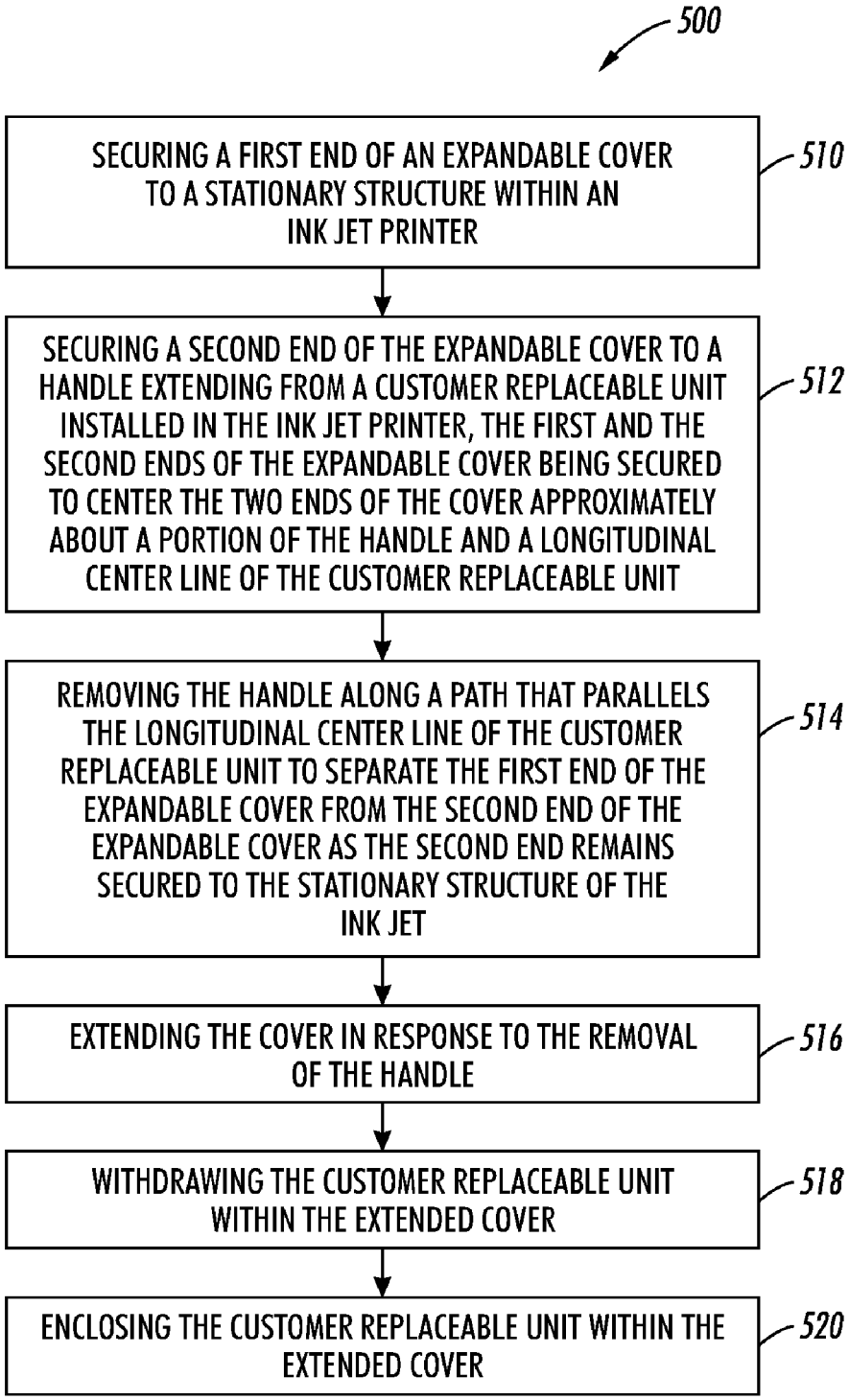
FIG. 6 is a flow diagram of a method for reducing debris during removal of a customer replaceable unit from a printer.

Referring now to FIG. 6, a flow diagram is depicted for a method 500 that reduces debris associated with the removal of a customer replaceable unit from a printer. The method 500 includes securing a first end of an expandable cover to a stationary structure within a printer (block 510), and securing a second end of the expandable cover to a handle extending from a customer replaceable unit installed in the printer (block 512). The first and the second ends of the expandable cover are secured to center the two ends of the cover approximately about a portion of the handle and a longitudinal center line of the customer replaceable unit.

The method 500 also includes removing the handle along a path that parallels the longitudinal center line of the custom replacement unit to separate the first end of the expandable cover from the second end of the expandable cover as the second end remains secured to the stationary structure of the ink jet printer (block 514). The cover is extended in response to removal of the handle (block 516) and the customer replacement unit is withdrawn into the extended cover (block 518). Extension of the cover may include the unfolding of the accordion structure discussed above or the unrolling of the plastic sleeve, which was also described above. The cover is closed to encase the customer replacement unit within the extended cover (block 520). If the embodiment of the cover having a door that moves across the second end of the cover is used, the method may also include closing of the door in response to the entirety of the customer replacement unit passing past the second end of the cover. Once the customer replaceable unit is enclosed within the cover, the second end of the cover is detached from the stationary structure in the ink jet printer and closed to encase the customer replaceable unit within the cover. With other embodiments described above, the closing of the cover to encase the customer replacement unit may include moving a pair of doors across the second end of the cover in response to the entirety of the customer replacement unit passing by the second end of the cover.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from the patentees and others.

What is claimed is:

1. An integrated apparatus comprising:

a customer replaceable unit configured for mounting within a printer;

a handle mounted to and extending from one end of the customer replaceable unit;

an extendable cover having a first end and a second end, the first end of the extendable cover being coupled to the handle and the second end of the extendable cover being configured to couple to a stationary structure within the printer to enable the customer replaceable unit to move past the second end of the extendable cover in response to the first end of the extendable cover being moved away from the second end of the extendable cover; and a pair of moveable doors located at the second end of the extendable cover, the moveable doors closing in response to the customer replaceable unit being entirely between the first end and the second end of the extendable cover.

2. The integrated apparatus of claim 1 further comprising:

a mounting plate attached to the second end of the extendable cover, the mounting plate being configured to engage the stationary structure in the printer.

3. The integrated apparatus of claim 1, the extendable cover having an accordion structure.

4. The integrated apparatus of claim 3, the extendable cover being corrugated paper having accordion folds.

5. The integrated apparatus of claim 1, the extendable cover having a telescoping structure.

6. The integrated apparatus of claim 1, the customer replaceable unit being a drum maintenance unit for an ink jet printer.

7. The integrated apparatus of claim 1, the extendable cover being a plastic sleeve.

8. An integrated apparatus comprising:

a customer replaceable unit configured for mounting within a printer;

a handle mounted to and extending from one end of the customer replaceable unit;

an extendable cover having a first end and a second end, the first end of the extendable cover being coupled to the handle and the second end of the extendable cover being configured to couple to a stationary structure within the printer to enable the customer replaceable unit to move past the second end of the extendable cover in response to the first end of the extendable cover being moved away from the second end of the extendable cover, the extendable cover having an accordion structure.

9. The integrated apparatus of claim 8, the customer replaceable unit being a drum maintenance unit for an ink jet printer.

10. The integrated apparatus of claim 8, the extendable cover being corrugated paper having accordion folds.

11. The integrated apparatus of claim 8 further comprising:

a mounting plate attached to the second end of the extendable cover, the mounting plate being configured to engage the stationary structure in the printer.

* * * * *